United States Patent [19]

Bass et al.

[11] 4,302,051

[45] Nov. 24, 1981

[54] OPEN SURFACE FLOTATION METHOD

[75] Inventors: Dan M. Bass, Golden; Fun-Den Wang, Lakewood, both of Colo.

[73] Assignee: The United States of America as represented by the Secretary of the Interior, Washington, D.C.

[21] Appl. No.: 75,385

[22] Filed: Sep. 13, 1979

[51] Int. Cl.[3] ..... E21B 43/24; E21C 41/10

[52] U.S. Cl. ..... 299/2; 166/265; 166/272; 166/303

[58] Field of Search ..... 299/2, 7, 8, 9; 166/265, 266, 267, 272, 302, 303; 210/170

[56] References Cited

U.S. PATENT DOCUMENTS

| | | | |
|---|---|---|---|
| 1,651,311 | 11/1927 | Atkinson | 166/275 |
| 3,050,289 | 8/1962 | Gerner | 299/9 X |
| 3,666,014 | 5/1972 | Beard | 166/272 X |
| 3,732,926 | 5/1973 | Brown et al. | 166/272 |
| 3,845,820 | 11/1974 | Allen et al. | 166/266 |
| 3,881,551 | 5/1975 | Terry et al. | 166/272 |
| 3,951,456 | 4/1976 | Ridley | 299/2 |
| 4,101,172 | 7/1978 | Rabbitts | 299/2 |
| 4,133,384 | 1/1979 | Allen et al. | 166/272 |
| 4,166,504 | 9/1979 | Brown et al. | 166/272 |
| 4,181,362 | 1/1980 | Burton | 299/2 |

*Primary Examiner*—Stephen J. Novosad
*Assistant Examiner*—George A. Suchfield
*Attorney, Agent, or Firm*—Donald A. Gardiner; Gersten Sadowsky

[57] ABSTRACT

A method for the in situ separation of viscous crude oil from a reservoir such as, oil sand, or tar sand is disclosed. Hot water is introduced to the top surface of the reservoir while steam is injected into the reservoir through drill holes. The hot water and steam may contain a surfactant. The bouyancy of the crude oil creates an artificial water drive which causes the water and oil to "flip-flop" so that the oil rises to the top of the reservoir and separates from the remainder of the reservoir material. If the overburden is deep, underground mining techniques may be used to reach the reservoir prior to applying the present method.

10 Claims, 8 Drawing Figures

OPEN SURFACE FLOTATION METHOD

BACKGROUND OF THE INVENTION

1. Field of the Invention

The present invention relates to a method for extracting crude oil from a reservoir. More particularly, it relates to a method for extracting crude oil from a reservoir in situ.

2. Description of the Prior Art

Vast quantities of crude oil reserves are to be found in reservoirs which do not permit oil extraction by the conventional methods. These crude oil reservoirs may be in the form of viscous tar sands whose available oil adheres to or between the sand particles and may not be pumped.

Another type of reservoir is a heavy viscous oil, or bitumen, reservoir. In such a reservoir, the bitumen is too viscous to be pumped by conventional pumping equipment.

Various attempts have been made to extract such crude oil in an economical manner. Such attempts have utilized, for example, the addition of wetting agents, surfactants, steam, water at elevated temperatures, micellar dispersions or in situ combustion. However, these prior art methods have recovered very small amounts of the in-place fluid and in some cases required that the reservoir material be extracted prior to the extraction of the crude oil.

Known extraction methods include open pit or strip mining and, in the case where the reservoir is covered with a thick overburden, underground mining of the sand or bitumen. However, such methods are uneconomical and environmentally unsound. Pit and strip mining require the removal of the overburden which requires subsequent land reclamation while extensive underground mining is expensive and weakens the covering overburden.

Applicants are aware of one oil sand extraction method, described in U.S. Pat. No. 1,651,311 to Atkinson, which attempts to extract crude oil without the prior extraction of the entire reservoir material, that is, in situ. In Atkinson, oil sand that has been naturally flooded with water is saturated with a strong alikali, such as soda ash, caustic soda or caustic potash, at ordinary temperatures. According to Atkinson, the alkali is introduced through existing well holes and overcomes the capillary, adhesive and viscous tendancies of the crude oil so that it separates from the sand. The crude oil then rises to the top of the already flooded wells and is removed.

However, Atkinson has several shortcomings. First, it requires large amounts of alkali. Second, it may only be used in already flooded wells. Finally, the alkali does not efficiently separate the crude oil from the sand.

SUMMARY OF THE INVENTION

It is therefore an object of the present invention to provide an economical and efficient method of crude oil extraction.

It is a further object of the present invention to provide a method of extracting crude oil from oil sands, or for extracting heavy viscous crude oil, which is environmentally sound.

It is yet another object of the present invention to provide a method for extracting crude oil from oil sands, or for extracting heavy viscous crude oil in situ.

These, and other objects of the present invention, are accomplished by a method of open surface flotation which creates an artificial "water drive" within the reservoir to displace the oil with water. The method essentially consists of introducing hot water to the top surface of a reservoir and injecting the reservoir with steam, all while the reservoir remains in situ. The stream is injected into the reservoir through drill holes drilled into the reservoir. The hot water and/or steam may include a surfactant to help separate the oil from the sand.

The hot water and steam heat the viscous oil and lower its viscosity while flooding the reservoir. Since the density of water is greater than that of oil, the crude oil and water at the top surface of the reservoir will perform a "flip-flop" and reverse positions because of gravity so that the oil rises to the top of the reservoir where it may be pumped out. The surfactant, if used, helps separate the sand or other reservoir material from the oil so that the sand or other reservoir material does not rise with the oil but remains at the bottom of the reservoir. However, even without the use of a surfactant, the lowered viscosity of the crude oil should permit the separation of the reservoir material from the rising crude oil.

Where the reservoir is covered with a moderate overburden, such as soil or rock, one or more caverns may be created by drilling in the overburden adjacent to the drill holes in the top surface. The caverns can then be filled with the hot water.

Where the reservoir is covered with a thicker overburden, a shaft may be dug to one or more tunnels and one or more drill holes drilled from the tunnels to the caverns. Where the overburden is very thick, a plurality of connected tunnels may be used, with two shafts to the tunnels.

The above method may be used both for those reservoirs which are water flooded (water wet sand) and those which are not (oil wet sand). For oil wet sand an alternative method may be used in which the reservoir material is first extracted by conventional methods and placed in open cells containing steam injection galleries. The open cells may then be covered with hot water and steam introduced through the steam injection gallaries. A heavy plastic sheet can cover the cells to control released gas.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein like reference characters designate like or corresponding parts throughout the several views, and wherein.

DETAILED DESCRIPTION OF THE PREFERRED EMBODIMENTS

The preferred embodiment will now be described with reference to the FIGURES, the numbering of similar elements in the FIGURES remaining constant throughout.

Figure 1:
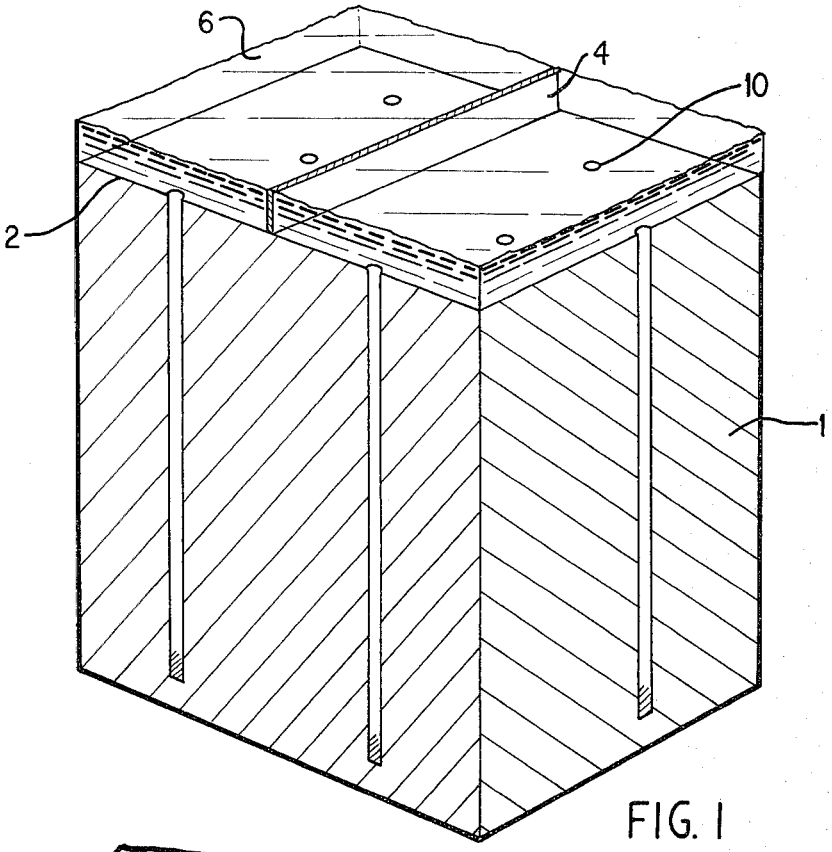
FIG. 1 is an orthogonal view of a portion of a reservoir to which the present method is to be applied.

In FIG. 1, the number 1 represents an ortongonal view of a portion of a crude oil reservoir. The reservoir may be in the form of oil sand, viscous crude oil or tar sand. Any debris resting on the top surface 2 of the reservoir must first be removed. Small amounts of overburden, if present, should also be removed. The boundaries of the reservoir, or sections thereof, may then be diked by appropriate dikes 4 of a height sufficient to retain the water therein.

The top surface 2 of the reservoir is then flooded with several feet of hot water 6. The hot water is preferably introduced at a temperature as close to 100 degrees C. as possible. The water should be at least 2 feet deep, and preferably from 6 to 10 feet deep. The water 6 softens the surface 2 of the reservoir and heats the oil adjacent the top surface, thereby decreasing its viscosity.

As the viscosity of the crude oil within the reservoir decreases and the crude oil becomes more flowable, it bouyancy, the force of gravity, the adhesive, and surface forces begin to create the "flip-flop" effect which causes the oil and water to reverse positions. Most crude oils are less dense per unit volume than the same unit volume of water. For example, 1 cubic foot of water at about 20 degrees C. weighs 62.32 pounds. 1 cubic foot of 30 degree API crude oil at atmospheric pressure and 60 degrees F. (about 15.5 degree C.) weighs 54.60 pounds. This is a difference of 7.72 pounds which is a bouyancy force of 0.0536 pounds per square inch per foot of heat directed upwards. This bouyancy force helps to create a water drive which forces the water downward and oil upward and tend to displace the oil in all portions of the reservoir.

Figure 2:
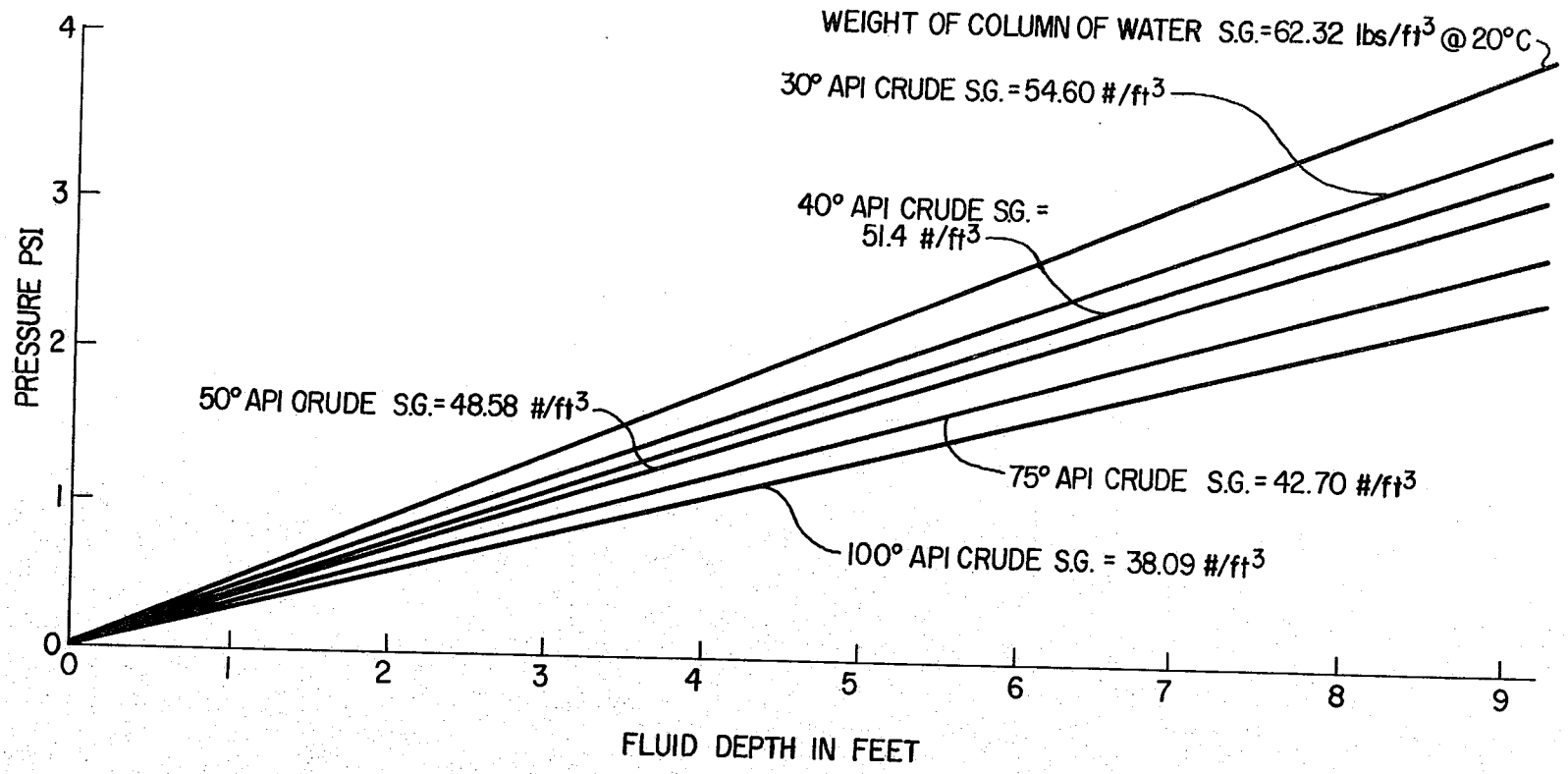
FIG. 2 is a graph showing the bouyancy force of various grades of oil as a function of the depth of an oil and water column.

FIG. 2 illustrates graphically the pressure gradient of the bouyancy force of a column of water for similar columns of various API gravity oils. As can be seen from FIG. 2, the bouyancy force of a column is the difference between the pressure for the water at a given depth and the pressure for a particular crude oil at the depth. For example, for a 6 foot column of water, and 100 API crude oil, the bouyancy force is approximately 2.7 PSI minus 1.4 PSI, which equals 1.3 PSI.

Figure 3:
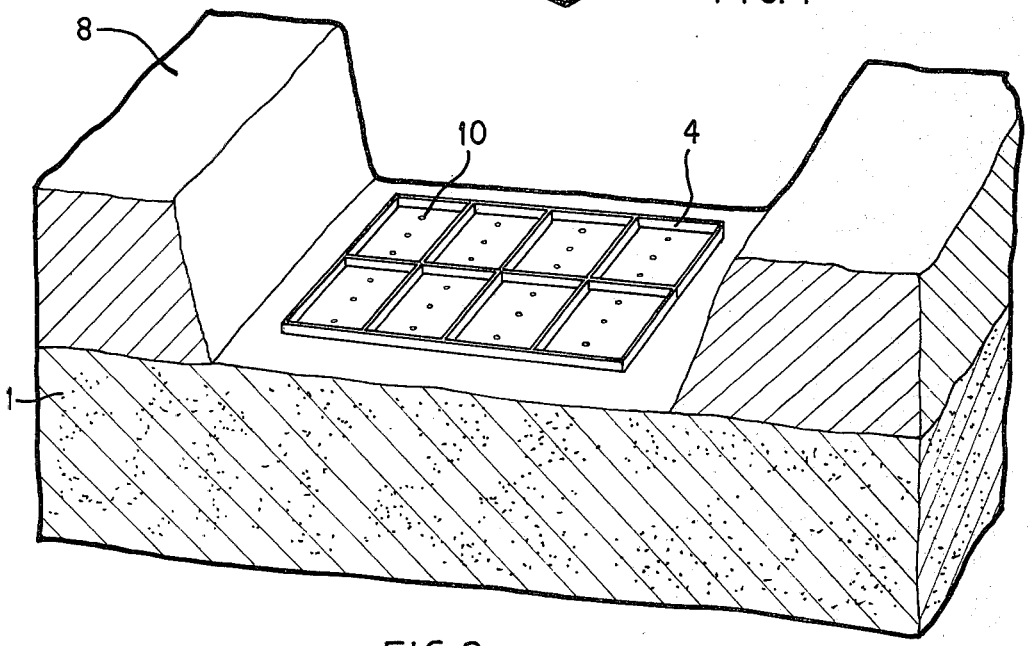
FIG. 3 is similar to FIG. 1 but shows a small depth of overburden.
Figure 4:
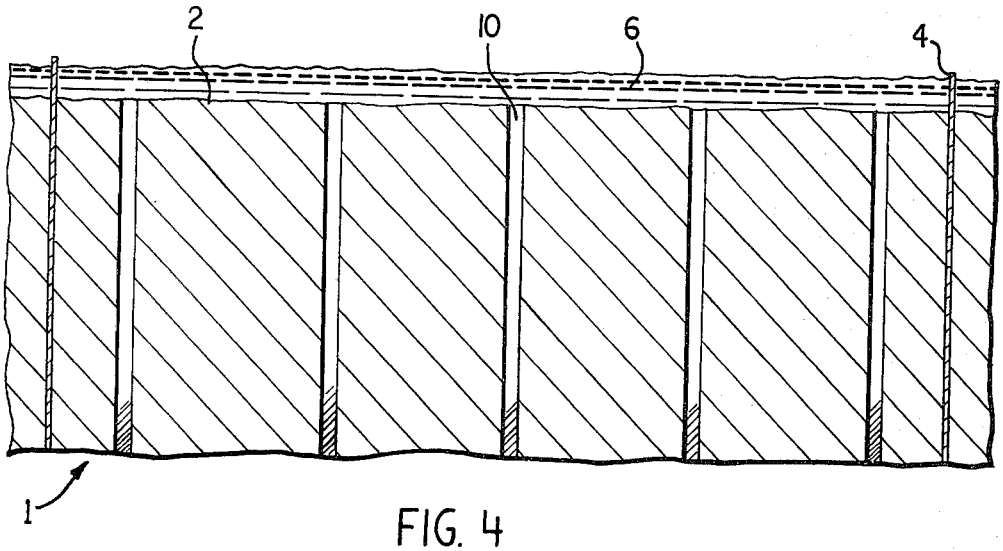
FIG. 4 is a side view of the reservoir in FIG. 1.
Figure 5:
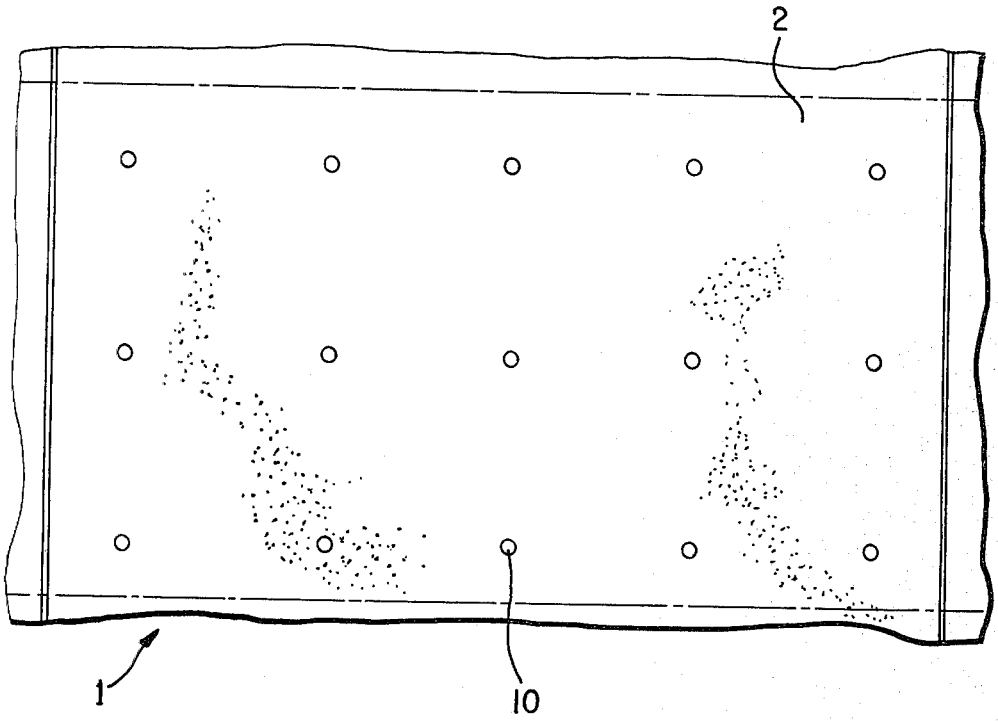
FIG. 5 is a plan view of the reservoir in FIG. 1.

FIG. 3 illustrates the reservoir with a thin overburden 8 which may be removed prior to the beginning of the process. FIGS. 4 and 5 are side and plan views of the reservoir 1 without overburden.

As part of the method of the present invention, undersaturated or super heated steam is introduced into the reservoir 1 at approximately the same time as the introduction of hot water. The steam may be introduced immediately before, immediately after, or during the introduction of the hot water. In order to facilitate the introduction of the steam, drill holes 10 are drilled into the reservoir from the top surface thereof. The drill holes are preferably directed vertically downwards and extend substantially all the way through, but not necessary completely through, the reservoir. The steam releases heat which is absorbed by the crude oil throughout the body of the reservoir, thereby decreasing its viscosity and permitting it to be displaced by the water as a result of the water drive already discussed. As the water and oil pass during the "flip-flop", the initial heat of the water prevents the water from absorbing the heat released by the steam, which would otherwise cool the crude oil and grain increase its viscosity.

The size and placement of the drill holes depend upon the particular type of reservoir and crude oil to which the present method is applied. The size and placing of the drill holes should be adequate to heat the reservoir and lower the viscosity of the crude oil to the extent that sand or other reservoir material can settle or flow through the crude oil at a rate equal to or greater than the rate that the crude moves upwards as it is displaced by the water. The objective is to leave the sand or other reservoir material in place. If the drill holes are too far apart or too small, thereby resulting in insufficient heat to the crude oil, the oil remains too viscous, and the reservoir material is unable to settle through the crude oil. On the other hand, if the drill holes are too large or too closely spaced, thereby resulting in excessive heat being applied to the crude oil, it will flow upwards too fast and carry the reservoir material up with it. Reservoir material in the crude oil creates problems in pumping, storage, distribution and processing.

The steam is introduced into the drill holes through any conventional type of steam introduction apparatus (not shown). The steam should have a steam quality of 30 to 100%., and preferably 60%.

The water and/or steam may contain surfactants such as sodium silicate, sodium hydroxide or some other well known type of surfactant. The particular type of surfactant used depends upon the type of reservoir material and crude oil. The surfactant may be introduced in an amount of 0.1% to 2% of the introduced fluid by weight. The surfactant helps to remove the adhered oil from the surface of the reservoir material, and more completely accomplishes the extraction of the crude oil from the reservoir.

Following the introduction of the steam and hot water, a period of time is required for the water drive created by the difference in bouyancy between the water and the crude oil, together with the surfactant, if used, to achieve the "flip-flop" phenomenon in which the crude oil and water exchange positions so that the crude oils moves to the top of the reservoir, while the water, and reservoir material which has settled from the less viscous crude oil, remain at the bottom of the reservoir. Following the completion of the "flip-flop" phenomenon, the crude oil may be easily pumped off of the top of the reservoir and transferred to storage or to a refinery for processing. However, the water and the reservoir material remain in situ.

It can therefore be seen that the cost and extent of damage to the environment because of the present process is considerably less than that of the typical prior art processes in which the reservoir material is first removed from the ground. Since the reservoir material remains in situ, it is not necessary to mine vast quantities of reservoir material or to replace the removed material following the extraction of the crude oil. Further, from an environmental point of view, the present in situ method is superior to the conventional prior art methods. Since the reservoir material is not bodily removed from the ground, the environmental disruption is considerably reduced. Although it may be necessary to remove shallow overburden, when such exists, the removal and replacement of overburden is less damaging to the environment than the removal of both the overburden and the reservoir material.

Further, in a situation where the overburden ranges from 200 feet to 500 feet, and where, in the prior art methods, removal of the overburden and reservoir material by strip or pit mining would have been necessary, the present invention permits the in situ removal of the crude oil without the removal of either the reservoir material or the overburden.

Figure 6:
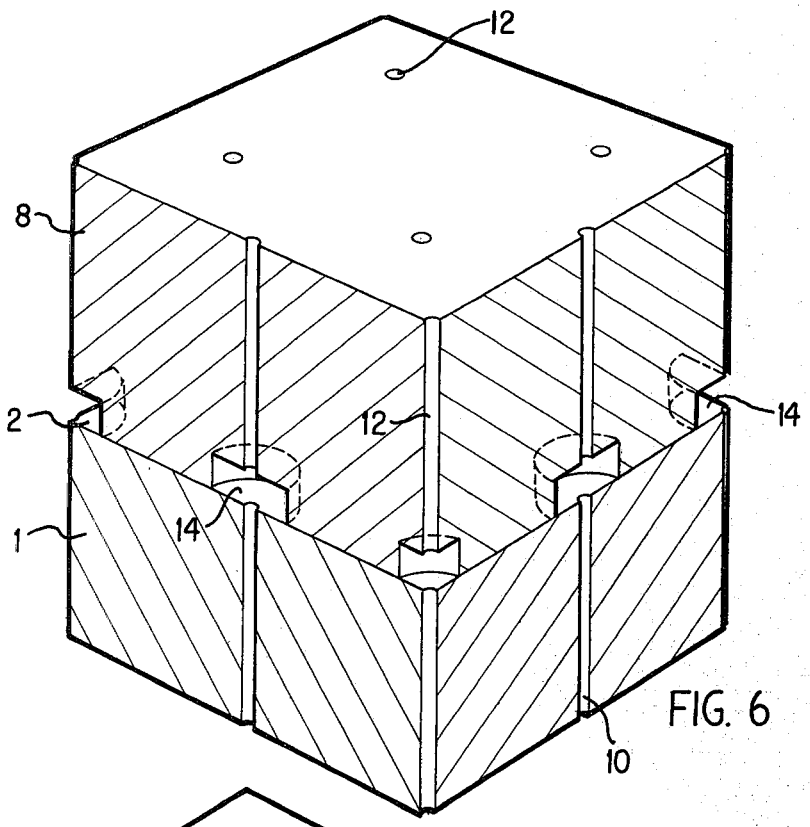
FIG. 6 is a view similar to that of FIG. 1 in which an overburden of 200 to 500 feet is shown.

As can be seen from FIG. 6, according to the present invention, if the overburden is of a depth of from 200 feet to 500 feet, drill holes 12 may first be drilled into the overburden material 8, to the depth of the reservoir top surface 2. A high pressure water jet (not shown) may then be introduced into the drill holes 12, to cut out a cavern 30 to 50 feet or more in diameter, adjacent the top surface 2. The hole and cavern may then be cleaned out by conventional apparatus and the drill hole 10 may be drilled into the reservoir, as before. Steam, water, and possibly a surfactant are then injected into the drill holes 12 and 10, as described above to create the artificial water drive mechanism. Following the "flip-flop" phenomenon, either the crude oil can be pumped out through the drill holes 12, or additional, production, drill holes (not shown) may be drilled. In this embodiment, the use of hot water at the top surface of the reservoir is optional. Further, any natural gas that may be released by the process of the present invention can be easily controlled by the retention of the overburden above the reservoir.

Figure 7:
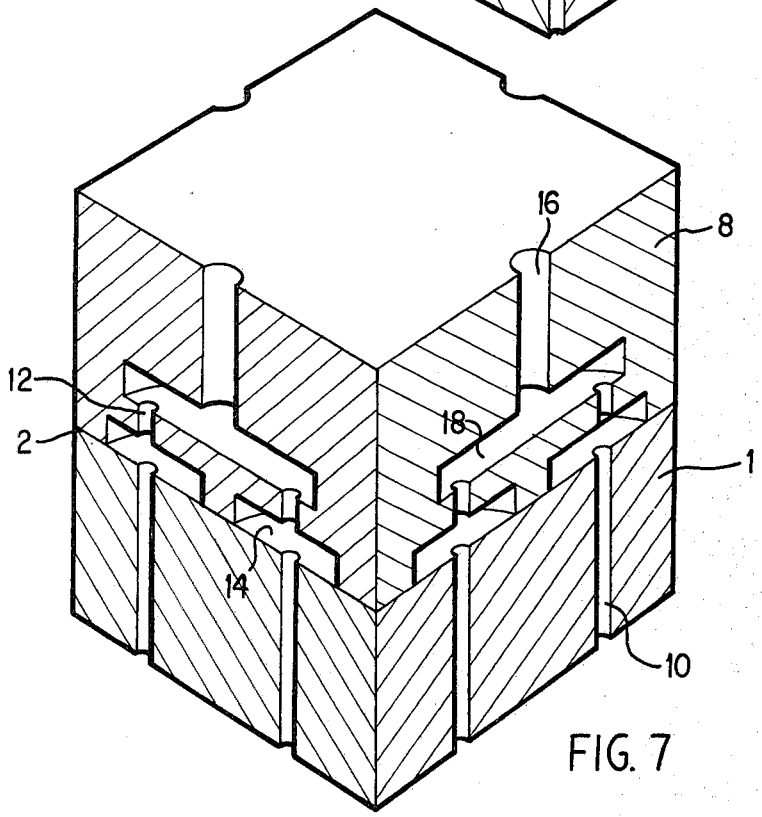
FIG. 7 is a view similar to that of FIG. 1 with an overburden of 500 to 1000 feet.

If the present invention is used for crude oil reservoirs having an overburden of greater depth, that is, 500 to 1000 feet, it is necessary to use some underground mining techniques, however, the underground mining is not as extensive or as deep as would be necessary in a conventional oil extraction method in which the reservoir material itself is removed. According to this embodiment, as illustrated in FIG. 7, mine shafts 16 are dug into the overburden to a depth sufficient so that a plurality of drill holes 12 may then be economically drilled to the top surface 2 of the reservoir. A horizontal tunnel 18 is then dug about the base of each shaft and a plurality of the drill holes 12 are drilled from the base of the tunnels to the surface 2. The caverns 14 are then jetted out as described above, the drill holes 10 are drilled from the tunnels into the reservoir, and steam, optionally together with a surfactant and hot surface water, is introduced through the drill holes 12 to create the artificial water drive as disclosed above. The separated oil may then be pumped out from the tunnels in a conventional manner.

Figure 8:
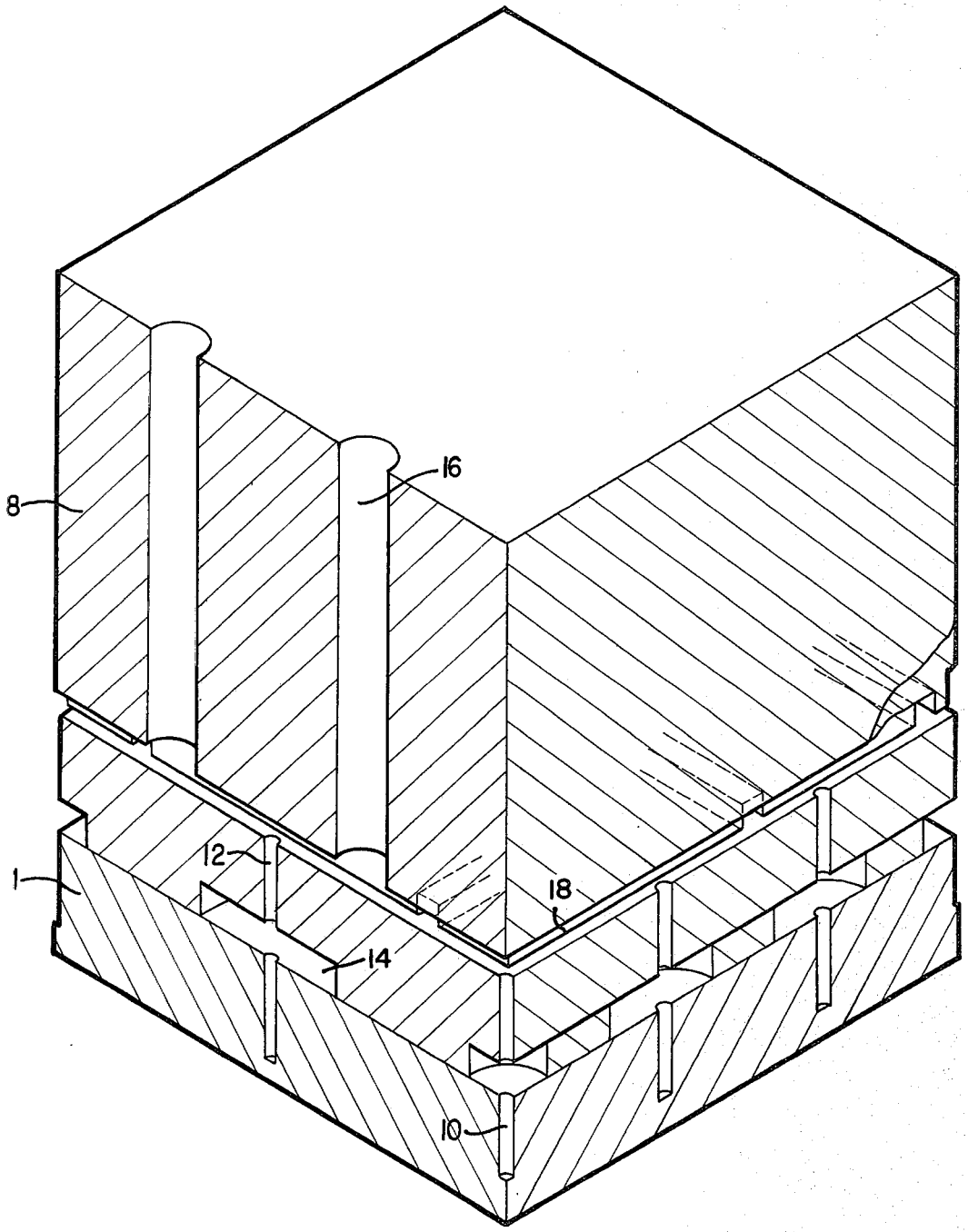
FIG. 8 is a view similar to FIG. 1 with an overburden of more than 1000 feet.

If the overburden is at a depth of from 1000 to 2000 feet or more, the digging of shafts becomes very expensive and only 2 shafts 16 are dug for an entire series of tunnels 18 as seen in FIG. 8. This embodiment is otherwise similar to that described immediately above.

The above embodiments are usable both in "oil-wet" reservoir material in which the reservoir material is initially not flooded with water, and "water-wet" reservoirs in which the reservoir material is initially flooded with water. Further, in the case of an "oil-wet" reservoir, the "flip-flop" process can be performed subsequent to the extraction of the reservoir material as well as in situ.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for the in situ removal of hydrocarbonaceous material from an earth formed reservoir of said material located within the earth, said method comprising the steps of:

introducing hot water upon at least a portion of a top surface of said reservoir forming a layer of hot water above said top surface and in contact therewith, injecting a heated fluid into said reservoir, where the earth formation thereof remains in situ, and the viscosity of said material is lowered by heat from said fluid and water, whereby said water moves down in said formation and said material of lowered viscosity is driven upwardly with displacement thereof being through said formation and said layer of water to and above the surface of said water layer, and collecting said displaced material from said surface of said water layer.

2. The method of claim 1 wherein said heated fluid is steam.

3. The method of claims 2 wherein said steam is introduced with a steam quality of from 30% to 100%.

4. The method of claim 1 including the step of drilling at least one hole into said reservoir for the injection of said heated fluid.

5. The method of claim 4 wherein an overburden covers said reservoir and including the step of forming at least one cavern in said overburden at said top surface of said reservoir, each said at least one cavern being formed in open communication with at least one of said at least one hole, and where by said layer of hot water is formed in said at least one cavern.

6. The method of claim 5 including the steps of forming at least one tunnel in said overburden, forming at least one shaft from the top surface of said overburden to at least one said at least one tunnel, and drilling at least one hole from at least one of said at least one tunnel to at least one of said at least one cavern.

7. The method of claim 1 including the step of adding a surfactant to said hot water.

8. The method of claim 1 including the step of adding a surfactant to said heated fluid.

9. The method of claims 7 or 8 or 1 wherein said surfactant is introduced in a concentration of from 0.1% to 2% by weight of fluid.

10. The method of claim 1 wherein said hot water is introduced to a depth of 6 to 10 feet.

* * * * *